United States Patent [19]

Billberg et al.

[11] Patent Number: 4,651,509

[45] Date of Patent: Mar. 24, 1987

[54] ARRANGEMENT ON PACKING MACHINES

[75] Inventors: Alf Billberg, Malmö; Paul Trädgårdh, Vollsjö, both of Sweden

[73] Assignee: Tetra Pak International AB, Lund, Sweden

[21] Appl. No.: 772,673

[22] Filed: Sep. 5, 1985

[30] Foreign Application Priority Data

Sep. 12, 1984 [SE] Sweden ..... 8404566

[51] Int. Cl.[4] ..... B65B 43/20

[52] U.S. Cl. ..... 53/565; 53/389; 271/131

[58] Field of Search ..... 53/565, 389; 271/2, 271/131, 139, 143; 493/309, 310, 311, 312

[56] References Cited

U.S. PATENT DOCUMENTS

| | | | |
|---|---|---|---|
| 133,184 | 11/1872 | Allen | 271/143 |
| 646,827 | 4/1900 | Harris | 271/2 |
| 649,161 | 5/1900 | Crowell | 271/2 |
| 1,151,792 | 8/1915 | Jaeger | 271/2 |
| 2,018,396 | 10/1935 | Burger . | |
| 3,380,732 | 4/1968 | Simpson | 271/143 |
| 3,584,434 | 6/1971 | Ellis . | |
| 3,698,154 | 10/1972 | Woodruff et al. . | |
| 3,768,381 | 10/1973 | Kopp . | |
| 3,777,907 | 12/1973 | Hannon et al. . | |
| 3,783,753 | 1/1974 | Rejsa | 271/131 |
| 4,127,977 | 12/1978 | Roehm | 53/565 |

FOREIGN PATENT DOCUMENTS

| | | |
|---|---|---|
| 348771 | 2/1922 | Fed. Rep. of Germany . |
| 636572 | 6/1983 | Switzerland . |
| 13782 | of 1913 | United Kingdom . |
| 711223 | 6/1954 | United Kingdom . |
| 1328308 | 8/1973 | United Kingdom . |
| 1340669 | 12/1973 | United Kingdom . |
| 2103563 | 2/1983 | United Kingdom . |

*Primary Examiner*—John Sipos
*Assistant Examiner*—Donald R. Studebaker
*Attorney, Agent, or Firm*—Burns, Doane, Swecker & Mathis

[57] ABSTRACT

A packing machine for the manufacture of packing containers wherein tubular packing container blanks which in flattened condition are placed into a magazine and wherein the feeding out of packing container blanks from the magazine is accomplished by a reciprocating driving element (7) located at the lower end of the magazine (7) which is provided with fingers which engage the open ends of the container blanks and to feed out one blank at a time is disclosed. As a result, a reliable operation, independent of the thickness of the blank, is obtained.

2 Claims, 3 Drawing Figures

ARRANGEMENT ON PACKING MACHINES

BACKGROUND OF THE INVENTION

The present invention relates to an arrangement on packing machines for the feeding out of flattened, tubular blanks from a stack magazine, this arrangement comprising a reciprocating driving element.

In packing machines for the manufacture of non-returnable packages of the so-called gable-top type, use is made in general of prefabricated tubular packing container blanks. The blanks which are manufactured from a laminated material comprising layers of paper and thermoplastics are provided with a number of wall panels divided by means of vertical crease lines, and can be laid flat therefore in a simple manner during handling and storage. In the packing machine the blanks in flattened condition are placed manually or automatically into a stack magazine, from which they are removed one by one in order to be raised to a square cross-sectional shape and subsequently be processed and converted to filled and closed packing containers.

Since the laminated packing material is relatively rigid, the flattened blanks have a tendency to open a little so that panels lying against each other do not rest on top of one another (so-called spring-back). This means in other words that the total thickness of the individual blanks when they are placed into the magazine may vary on the one hand owing to individual differences, and on the other hand because of the pressure exercised by the blanks lying on top. As the blanks are fed out one at a time from the lower end of the magazine the varying thickness of the blanks causes great difficulties, especially in cases of the feeding-out arrangement generally used up to now, where a slot or opening of limited height is made use of in order to restrict the feeding out to an individual packing container blank at a time. This type of feeding-out arrangement is shown in Swedish patent application 8301122-1, and it is the purpose of the present invention, in principle, to provide an improvement of this feeding out arrangement.

OBJECTS AND SUMMARY OF THE INVENTION

It is an object of the present invention to provide a feeding-out arrangement on a packing machine wherein the feeding-out arrangement ensures the feeding out of an individual packing container blank at a time irrespectively of the thickness of the blanks handled.

It is a further object of the present invention to provide an arrangement of a simple, inexpensive design which is of great reliability.

It is a further object of the present invention to provide a feeding-out arrangement which makes possible the feeding-out of the packing container blanks at a high rate and which can be combined without great difficulties with the types of conveyors and raising arrangements for packing container blanks used on known packing machines.

These and other objects have been achieved in accordance with the invention in that an arrangement has been given the characteristic that the driving element comprises driving fingers which are located on either side of the lower end of the magazine and which are adapted so that on movement of the driving element they engage and drive forward a blank situated lowermost in the magazine.

The design of the feeding-out arrangement in accordance with the invention is based on a new principle which functions irrespective of the thickness of the blanks handled, since the driving element acting upon the blank only engages and feeds out one blank at a time. This is made possible by the fingers of the driving element in co-operation with the edge contour of the blank being guided in into each individual blank as a result of which the feeding-out functions safely without being affected by the thickness of the blank. Consequently it is possible to handle blanks of different quality so that the proportion of rejected blanks, which cannot be handled, is substantially reduced.

DESCRIPTION OF THE DRAWING

A preferred embodiment of this invention is illustrated in the accompanying drawings in which.

DETAILED DESCRIPTION

Figure 1:
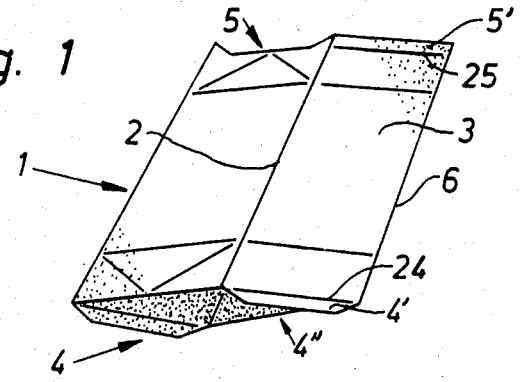
FIG. 1 is a perspective view of a known type of packing container blank which the arrangement in accordance with the invention is intended to handle.

In FIG. 1 is shown a tubular packing container blank 1 of known type. The feeding-out arrangement in accordance with the invention is designed to co-operate with this or similar types of packing container blanks. The blank 1 is manufactured from a laminated material which comprises a carrier layer of paper which is coated on both sides with thermoplastic material, usually polythene. The blank 1 is divided by means of a number of longitudinal or vertical crease lines 2 into four sidewall panels 3, and it is divided by means of further crease lines into a number of folding and sealing panels. This design of the packing container blank is well known, and is described in more detail in Swedish patent application no. 8105070-0, so that it does not have to be described in detail in this connection. The design of the short sides 4,5, however, is essential for the function of the feeding-out arrangement, since the feeding-out arrangement co-operates with sealing panels 4' and 5' and the cutouts 4" and 5" present on the short sides 4,5 most of which are visible in the partly flattened packing container blank shown in FIG. 1. In flattened condition of the blank 1 one of the mutually parallel crease lines 2 will form the front edge 6 of the blank, namely the crease line which in flattened condition of the blank is frontmost when the blank is fed out by means of the arrangement in accordance with the invention, which will be described in more detail in the following.

Figure 2:
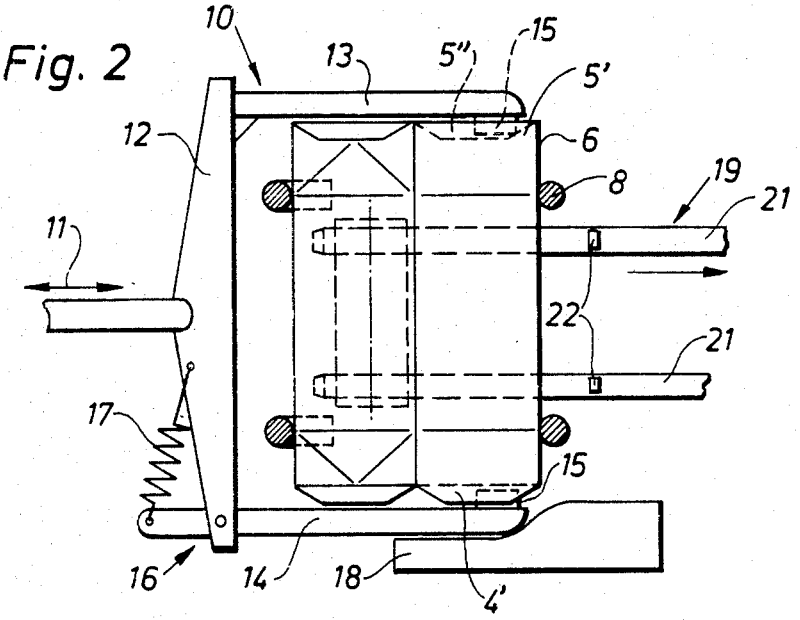
FIG. 2 shows the feeding-out arrangement in accordance with the invention from the top and partly in section.
Figure 3:
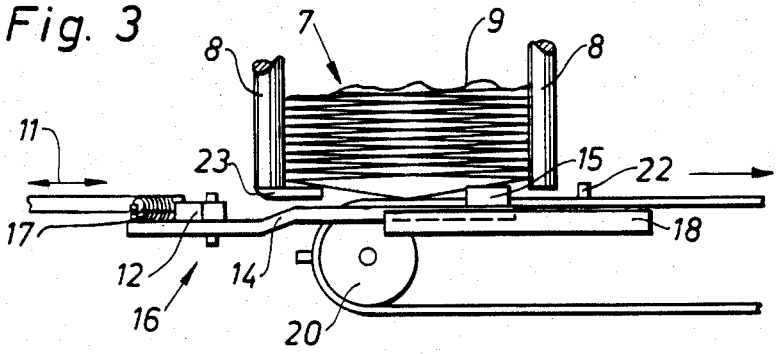
FIG. 3 shows the arrangement in accordance with FIG. 2 from the side.

The feeding-out arrangement in accordance with the invention is designed, as mentioned previously, so that it makes possible the feeding out of packing container blanks 1 from a stack magazine 7 which, as is evident from FIGS. 2 and 3, comprises four guides 8 on the sides of the stack 9 of packing container blanks 1. Further supporting elements are present at the short sides 4,5 of the blanks but these are not shown in the figures for the sake of clarity. At the lower end of the magazine 7 is a driving element 10 which is movable reciprocally in transverse direction to the blanks 1 and is supported and guided in the frame of the arrangement (not shown) by means of guides and other control devices which for the sake of greater clarity are not shown in FIGS. 2 or 3 but which may be of conventional type, e.g. rails of low-friction material or the like. The driving element 10 movable in transverse direction to the blanks 1 (the direction of movement is indicated by means of the arrows 11) comprises a transverse yoke 12 which at its ends has projecting, substantially parallel arms 13,14. The driving element 10, as mentioned previously, is situated horizontally, directed underneath the lower end of the magazine 7, and the distance between the two arms 13,14 substantially corresponds with, or slightly exceeds, the width of the magazine 9 and the blanks 1 contained therein. The arms 13,14 are provided at their front end with driving fingers 15 which extend towards each other so that the distance between their outer ends is less than the length of a blank located between them (that is to say the dimension of the blank in transverse direction in relation to the direction of movement of the driving element 10) which means that the driving fingers can engage the short sides 4,5 of the blank and the sealing panels 4',5' present on these, which will be explained in more detail in the following.

One arm 14 of the driving element 10 is connected by means of a link 16 to the yoke 12 so that it can swivel and it is adapted so that it swivels in the plane of the driving element 10, that is to say substantially horizontally in the plane of the flattened blank 1. The rear end of the arm 14 located behind the link 16 is attached to the yoke 12 by means of a tension spring 17 in such a manner that the front end of the arm 14 provided with the driving finger 15 aims at being turned outwards from the central part of the driving element 10 (clockwise in FIG. 2) and the blank 1 present there. However, by means of a control element 18 fixed to the frame of the arrangement, the arm 14 is retained in its original position substantially parallel with the arm 13 when the driving element 10 is in its rear position, as shown in the figures. The control element 18 is of such a shape that as the driving element 10 is moved forward (that is to say to the right in FIGS. 2 and 3) the arm 14 will be turnd inwards against the effect of the spring 17 towards the central part of the driving element 10 so that its driving finger 15 is pushed in into the blank between the side wall panels 3 of the blank and gradually engages the front edge 6 of the blank, which will be described in more detail in the following.

Underneath the magazine 7 partly between the arms 13,14 of the driving element 10 a conveyor 19 is located comprising an end pulley 20 which is situated at a little distance below the lower end of the magazine 7. The conveyor 19 comprises three substantially parallel belts 21 which are provided at equal distances with projecting noses 22 intended for driving along a blank 1 fed out from the magazine. The distance between the upper part of the conveyor 19 and the bottom blank 1 situated in the magazine 7 is such that the noses 22 can pass freely at a short distance from the underside of the blank without making contact with the blank.

When the arrangement in accordance with the invention during operation is to feed out continuously one blank at a time from the magazine 7, the packing container blanks 1 are positioned in the first place automatically or manually between the guides 8 so that a stack 9 of the desired height is formed. The stack will rest on the lowermost blank which is prevented from leaving the magazine on the one hand by supporting elements 23 provided on certain of the guides (e.g. the two rear ones seen in the direction of feed of the blanks) which extend in underneath the blank to approximately one-third of the width of the wall panels 3 adjoining the rear guides 8, and on the other hand by the two driving fingers 15 whose active parts co-operating with the blanks are in the shape of plates located in the plane of the blanks whose length, seen in the direction of movement of the driving element 10, is shorter than the length of the sealing panels 4',5' with which they co-operate, and preferably amounts to approximately one-third of the length of the said panels. The driving fingers 15 extend in underneath the two sealing panels 4',5' and thus form, together with the two supporting elements 23 which are fixed to the guides 8 of the magazine, a number of points of support for the lowermost packing container blank 1 situated in the stack 9, thus preventing the same from leaving the magazine 7 when the arrangement is in rest position. As is clearly evident from the drawing, the driving fingers 15 extend in only underneath the actual sealing panels 4',5' and do not touch, therefore, the sidewall panel 3 located inside the packing container blank, which is separated from the sealing panels 4',5' by means of crease lines 24,25. Since in flattened condition of the blank the two sealing panels 4',5' are situated right in front of the cutouts 4'',5'' of the opposite wall panel 3, the driving fingers 15 will come to rest automatically against the inside of the sealing panels 4',5'. When the driving element 10 is to feed out blanks from the magazine, the driving unit (e.g. a conventional driving arrangement comprising an electric motor and a cam), not shown on the drawing, is started so that a reciprocating movement in the direction of the arrow 11 is imparted to the driving element 10. From its rest position shown in FIGS. 2 and 3 the driving element 10 is thus moved towards the right in the figures, the driving fingers likewise moving towards the right and thereby sliding towards the underside of the two sealing panels 4',5' until the driving finger 15 of the fixed arm 13 with its front end comes to rest against the inside of the front edge 6 of the blank 1. During the movement of the driving element, the moving arm 14, owing to its being in contact with the control element 18, will be moved successively inwards until its driving finger 15 has been moved in past the cut-off end of the front edge 6 so that this driving finger 15 too will be in contact with, and rest at the back of, the front edge 6 of the blank. As soon as this has happened the continued movement of the driving element 10 towards the right will have the result that the bottom blank 1 will commence to be moved towards the right out of the magazine and will slide underneath the bottom end of the two front guides 8 seen in the direction of feed. The movement of the driving element 10 continues until the rear edge of the packing container blank 1, seen in the direction of movement, leaves the two supporting elements 23 and drops down onto the two belts 21 of the conveyor 19. The conveyor 19, whose movement is continuous, will engage the rear end of the blank with the help of the noses 22 and take over the driving of the blank. The two driving fingers, during simultaneous return movement of the driving element 10, will relinquish the two rear edges of the sealing panels 4',5' and slide in underneath the corresponding sealing panels of the subsequent packing container blank so that these are resulted in the magazine 7 and fed out in the subsequent working stroke of the driving element 10. On return movement of the driving element 10 the spring 17 acts upon the arm 14 in such a manner that its rear part follows the control element 18 and thus slides out of the blank 1 so that the outer edge of the latter can pass freely the boundary line of the cutout 4'' and make contact with the underside of the sealing panel 4' situated above it.

On continued operation of the feeding-out device in accordance with the invention the driving element 10 will perform repeated working and return strokes and the fed-out sheets will be carried away continuously with the help of the conveyor 19. Since the driving element 10 with its driving fingers 15 in each working stroke engages and carries along each packing container blank individually, the feeding out of one blank at a time will take place with very great safety. In practical trials it has been established that the risk of feeding out more than one sheet at a time as well as the risk of failing to feed out at all can be fully eliminated with the arrangement in accordance with the invention. At the same time the arrangement has been found to operate at very high speed which is a great advantage in modern high-capacity packing machines.

While this invention has been described in accordance with a preferred embodiment of the invention, it is recognized that variations and changes may be made therein without departing from the invention as set forth in the claims.

We claim:

1. Apparatus for the feeding-out of flattened, tubular blanks comprising:

a stack magazine to receive a stack of flattened tubular blanks, said magazine having a front and a rear, a lower end and a fixed support element at the lower end of the magazine to support one end of the lowermost blank of a stack of blanks that may be inserted in the magazine;

a reciprocating driving element generally positioned below said magazine and reciprocating between a rear position and a front position, said driving element including a pair of opposed driving fingers which are positioned on opposite sides of the lower end of said magazine, said driving fingers being located directly underneath the magazine when said driving element is in the rear position and said driving fingers being a distance in front of the magazine when said driving element is in the front position said distance sufficient to permit a blank to be driven to clear said fixed support element, at least one of said driving fingers being transversely moveable with respect to the other of said fingers within the plane of movement of said driving element, said driving fingers being capable of contacting therebetween the opposite edge contours of the lowermost blank of a stack of blanks that may be inserted into the magazine, said driving fingers and said support element capable of retaining a stack of blanks that may be inserted in the magazine before movement of said driving element, said driving fingers capable of engaging and driving forward a blank that may be situated in the magazine away from said fixed support element one blank at a time upon forward movement of said driving element; and a fixed control element positioned adjacent said transversely moveable driving finger, said fixed control element contacting said finger when said driving finger is moved toward said front position to move said finger toward said opposed driving finger in the plane of movement of the driving element, said moveable driving finger being forced by said fixed control element into one end of a tubular blank to be driven.

2. Apparatus as in claim 1, further including an endless conveyor positioned below said magazine to receive blanks to be driven from said stack by said reciprocating driving element.

* * * * *